US007021751B2

(12) United States Patent
Merz et al.

(10) Patent No.: US 7,021,751 B2
(45) Date of Patent: Apr. 4, 2006

(54) ROBUST GASKET SEAL FOR AN INKJET PRINTHEAD

(75) Inventors: Eric Alan Merz, Palmyra, NY (US); Brian S. Hilton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 158 days.

(21) Appl. No.: 10/747,201

(22) Filed: Dec. 30, 2003

(65) Prior Publication Data

US 2005/0140758 A1 Jun. 30, 2005

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 4,485,064 A * 11/1984 Laurin ..... 264/242
6,260,961 B1 * 7/2001 Seu et al. ..... 347/87
6,286,950 B1 * 9/2001 Altendorf et al. ..... 347/86

* cited by examiner

*Primary Examiner*—David Gray
*Assistant Examiner*—Brian J. Goldberg
(74) *Attorney, Agent, or Firm*—Oliff & Berridge, PLC

(57) ABSTRACT

A mechanism for sealing a cover to a container for storing ink in an inkjet cartridge is provided. The mechanism includes a container for storing ink, a cover and a gasket. The cover fits over the container and the gasket is interposed between an inside edge of the cover and an outside edge of the container. Inkjet cartridges and printing apparatuses employing such mechanisms are also provided.

20 Claims, 7 Drawing Sheets

ROBUST GASKET SEAL FOR AN INKJET PRINTHEAD

BACKGROUND OF THE INVENTION

1. Field of Invention

This invention is directed to cartridges for inkjet printing. In particular, this invention is directed to gasket seals for sealing a cover of a cartridge for inkjet printing to the cartridge body.

2. Description of Related Art

Numerous printing apparatuses employ inkjet cartridges to perform their printing functions. Inkjet cartridges generally include containers for storing ink and for delivering that ink to a printhead. It is often necessary to store the ink in a partial vacuum environment. In operation, it is preferable that ink does not escape from the container for storing ink. Similarly, it is preferable that various elements in the environment of the ink cartridge not enter into the container for storing ink. These preferable conditions are often maintained by forming a seal between a cover and the container for storing ink to isolate the container from its environment. Ideally, such seals will not adversely affect the ink stored in the container. To manufacture inkjet cartridges simply and economically, it also preferable that the seal be applied in a consistent and reliable manner. Also, it is desirable that the seal be such that it is possible to unseal and reseal the inkjet cartridge.

One known approach for sealing a cover to a container for storing ink in an inkjet cartridge is to employ an adhesive. A shortcoming of such an approach is that seals formed using adhesives can degrade upon contact with the ink stored in the container. Alternatively, some adhesives employed in such an application will adversely affect the ink. Use of adhesives to seal containers for storing inks in inkjet cartridges can also complicate manufacture. Manufacture can be complicated by the length of time necessary to cure adhesives. Also, inconsistencies in adhesive compositions can result in inconsistencies in the seals from inkjet cartridge to inkjet cartridge. Further, when heat is used to cure adhesives, such heat can damage portions of the inkjet cartridge unrelated to the seal.

Another known approach for sealing a cover to a container for storing ink in an inkjet cartridge is to employ welding techniques, such as ultrasonic welding. In order to employ an approach such as ultrasonic welding, the parts to be sealed (i.e., the cover and the container for storing ink) must be parts compatible with welding processes. Often such is not the case in inkjet cartridge manufacture. Further, the welding energy can heat, melt and/or crack unrelated parts of the inkjet cartridge, which can damage those unrelated portions. Ultrasonic welding also necessitates exacting manufacturing conditions. For example, the parts to be welded must be generally planar at the surfaces to be welded and the pieces to be welded must be supported in precise positions. Such requirements can enhance the complexity, and thus cost, of manufacture. Further, damage to an ultrasonic seal is extremely difficult to repair.

Employing welding techniques to seal a cover to a container for storing ink also creates difficulties relating to the types of materials that can be used to form the ink container and the cover. For example, some materials, such as liquid crystal polymer (LCP) and DELRIN, simply are not suitable for welding. Problems are also presented when different materials are used to form the ink container and the cover. For example, one or both of the materials may be unsuitable for welding. Alternatively, the conditions under which welding must be conducted may differ between the material used to form the ink container and the material used to form the cover.

A further approach for sealing a cover to a container for storing ink in an inkjet cartridge is to employ a gasket between the cover and the container. The gasket is generally "sandwiched" between the cover and container, and requires that pressure be applied mechanically to hold the cover and container together. The gasket in such an arrangement exerts a force that acts to separate the cover from the container. The mechanical means used to hold cover, gasket and container together can degrade and/or adversely affect the ink stored in the cartridge.

A still further approach for sealing a cover to a container for storing ink in an inkjet cartridge is described in U.S. Pat. No. 6,286,950, which is incorporated herein by reference in its entirety. This approach involves inserting the cover into the container, and situating a gasket between the portion of the cover that is inserted into the container and an inner wall of the container. The gasket forms a seal between the cover and the receptacle, and the force exerted by the gasket as to the parts with which it is in contact is normal, rather than parallel, to the direction in which those parts are connected.

SUMMARY OF THE INVENTION

Notwithstanding the merits of the above approaches, there is still a need for approaches for sealing a cover to a container for storing ink in an inkjet cartridge. In particular, there is a need for a seal that can be simply and cost-efficiently manufactured while achieving the reliability and quality necessary in inkjet printing applications. The present invention meets those needs.

The present invention is directed to mechanisms for sealing a cover to a container for storing ink in an inkjet cartridge, and inkjet cartridges and printing apparatuses employing such mechanisms.

In various exemplary embodiments, the mechanism for sealing a cover to a container for storing ink in an inkjet cartridge according to this invention includes a container for storing ink including an inside surface, an outside surface and peripheral edge of the outside surface adjacent to an opening of the container. In various exemplary embodiments, the mechanism includes a cover having an inside surface, an outside surface and an inner edge on the inside surface. In various exemplary embodiments of the mechanism, the cover is structured so as to fit over the container, such that the peripheral edge of the outside surface of the container is adjacent to the inner edge of the inside surface of the cover when the container is closed. In various exemplary embodiments a gasket is situated on the peripheral edge of the outside surface of the container, such that, when the container is closed, the gasket is disposed between and in contact with the peripheral edge of the outside surface of the container and the inner edge of the inside surface of the cover. In various exemplary embodiments, a direction of compression of the gasket is normal to a direction in which the cover is applied to the container.

Because the present invention employs one or more gaskets to seal the cover to the ink container in an inkjet cartridge, instead of relying on welding, a wide variety of materials can be used to form the container and cover including, but not limited to ceramics, metals and polymers, such as liquid crystal polymer and acetal homopolymers (e.g., DELRIN). For example, materials that are not suitable for welding may be used to form one or both of the container and the cartridge. In addition, the material used to form the container may differ from the material used to form the cover.

In various exemplary embodiments, the inkjet cartridges according to this invention include such mechanisms for sealing a cover to a container for storing ink.

In various exemplary embodiments, the printing apparatuses according to this invention include inkjet cartridges including such mechanisms for sealing a cover to a container for storing ink.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

While the descriptions below refer to one specific type of fluid ejection system, i.e., an inkjet printer cartridge, the following descriptions of various exemplary embodiments of the inkjet cartridges according to this invention employ structural configurations that are usable in other fluid ejection systems and/or other technologies that store and consume fluids. As applied herein, fluids refer to non-vapor (i.e., relatively incompressible) flowable media, such as liquids, slurries and gels. It should be appreciated that the principles of this invention, as outlined and/or discussed below, can be similarly applied to any known or later-developed fluid ejection systems, beyond the inkjet cartridges specifically discussed herein.

Figure 1:
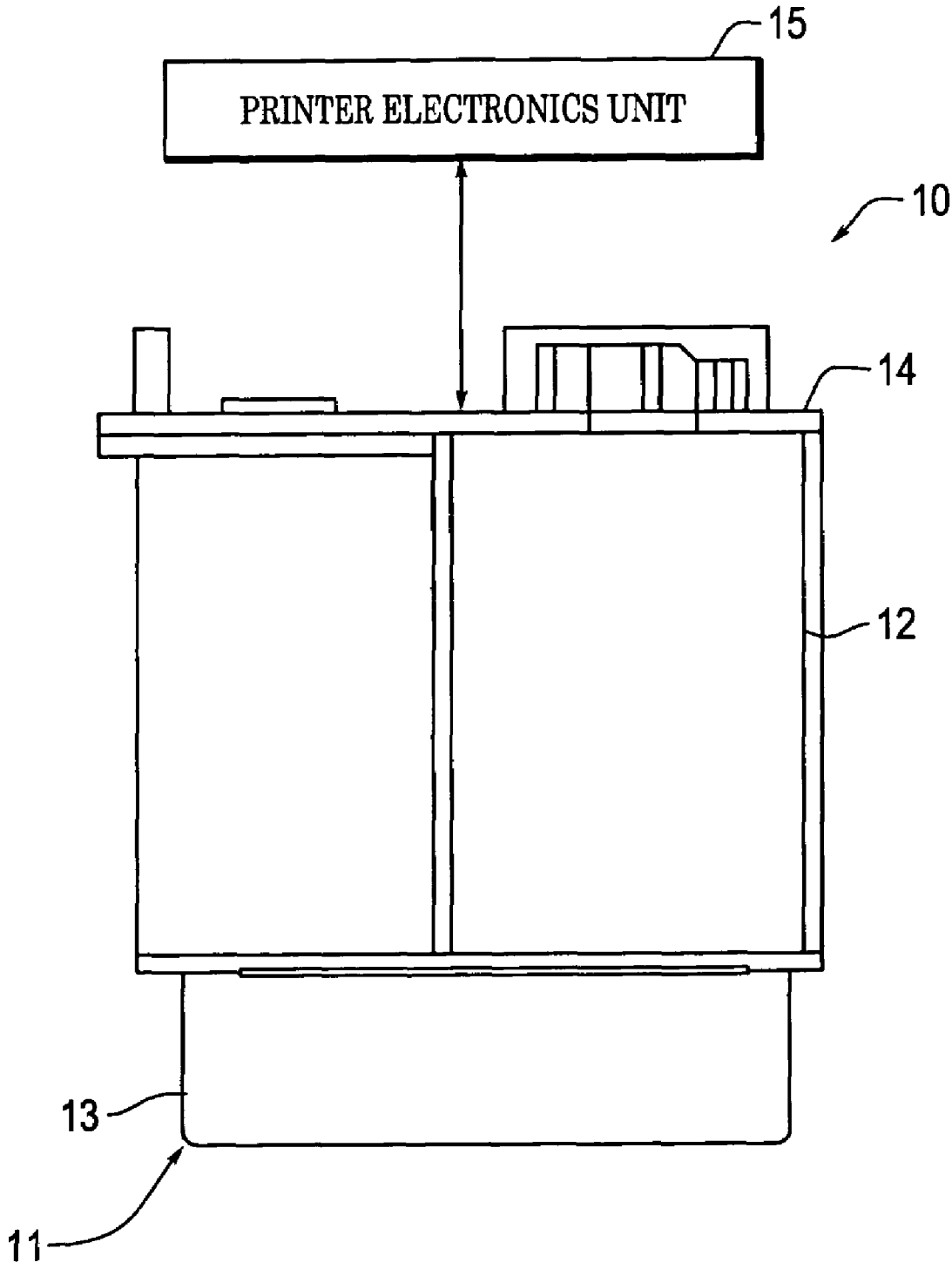
FIG. 1 shows a schematic of an exemplary embodiment of a printing apparatus according to this invention.

FIG. 1 schematically depicts an exemplary embodiment of a printing apparatus 10 according to this invention. Printing apparatus 10 includes an inkjet cartridge 11 that includes an ink container 12 and a printhead 13. The container includes a cover 14. The inkjet cartridge 11 receives signals from printer electronics unit 15, and, in response, selectively deposits ink onto recording media.

Figure 2:
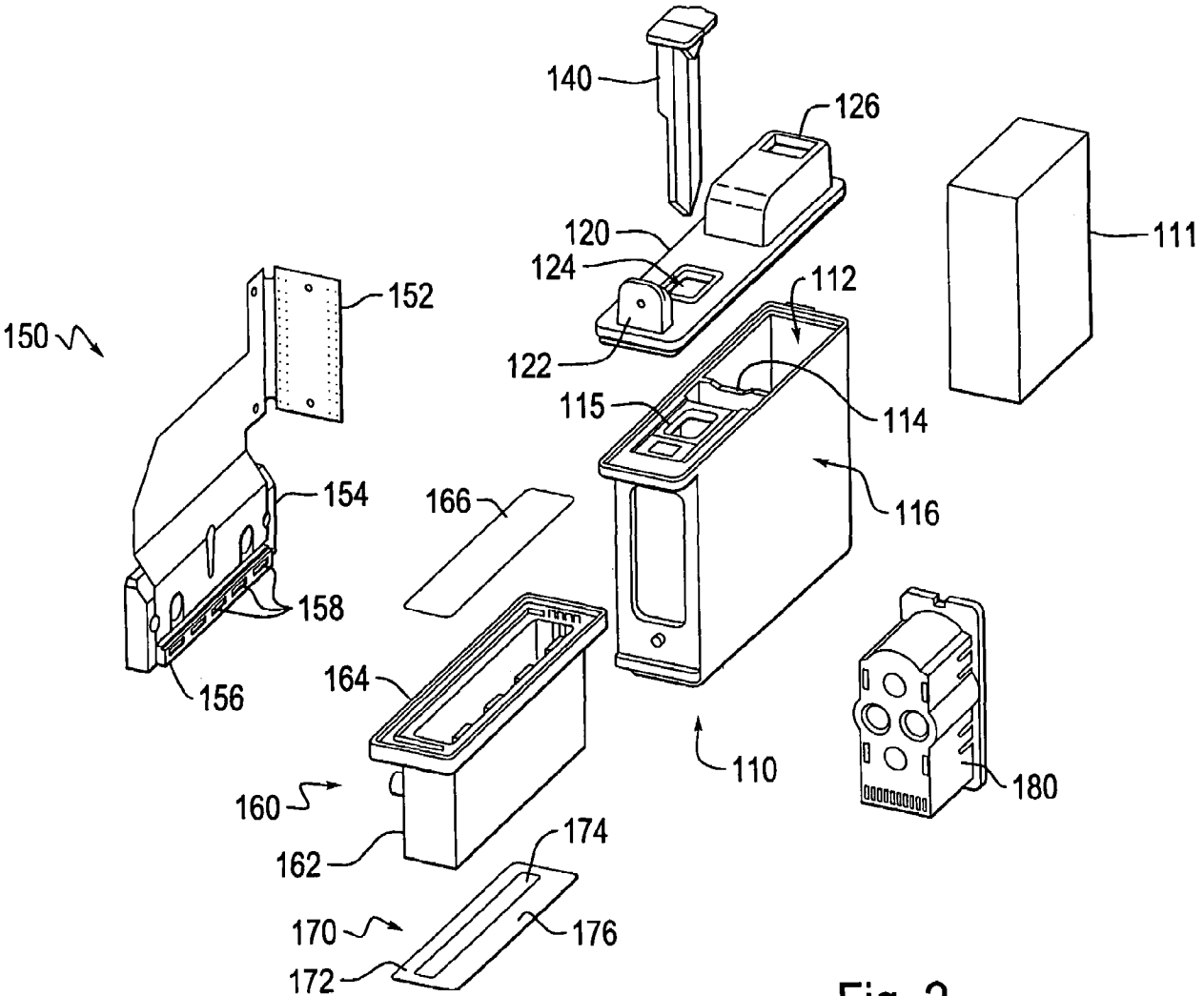
FIG. 2 shows an exploded view of an exemplary embodiment of an inkjet cartridge according to this invention.

FIG. 2 shows an isometric exploded view of an exemplary inkjet printer cartridge 100. The inkjet printer cartridge 100 includes an ink container 110, a cover 120, a fluid-level-measuring prism 140, a fluid ejection interface module 150, a manifold 160, a face tape 170 and a refill port 180. A capillary medium insert 111 can be inserted into the ink container 110.

The ink container 110 includes a cartridge medium chamber 112 and a free chamber 116. The capillary medium insert 111 can be received into the cartridge medium chamber 112 through an open top before the cover 120 is disposed on the ink container 110. Above the free chamber 116 is disposed a frame 115 that receives the prism 140. A partition 114 separates the cartridge medium chamber 112 and the free chamber 116 to enable separate fluid levels in the two divided chambers, but enabling fluid to communicate under the partition 114 along a bottom gap (not shown). The bottom gap provides a passage for the fluid between the cartridge medium and free chambers 112 and 116. The free chamber 116 is otherwise isolated, while the cartridge medium chamber 112 is connected to the ventilation port 122 to enable air to communicate therebetween. Thus, the cartridge medium chamber 112 acts as a check valve to the free chamber 116, to enable fluid to pass, while preventing air to enter the free chamber 116 until the fluid level in the cartridge medium chamber 112 falls beneath the partition 114.

The capillary medium insert 111 allows the fluid to migrate from a wet region to a dry region by means of capillary wicking, such as for foam or felt materials. Such capillary media enable negative gauge pressure within the ink container 110. A vent path is connected to the top of the capillary medium insert 111 to allow the fluid to be removed therefrom, and be displaced by air.

The cover 120 includes a ventilation port 122, a prism window 124 and a bridge 126. The prism 140 can be received into the prism window 124 and inserted into the free chamber 116 within the frame 115. The ventilation port 122 includes orifices connecting from outside to inside the inkjet printer cartridge 100 for equilibrating the cartridge medium chamber 112 to ambient pressure.

The interface 150 includes a flexible circuit 152, a heatsink 154 and an ejection chip 156 having intake ports 158. The flexible circuit 152 provides the communication path for signals to eject fluid on command. The heatsink 154 attenuates the temperature response from heating by electrical resistance. Adjoining the heatsink 154 is the ejection chip 156. The intake ports 158 provide passage for fluid to be controllably released by fluid ejection nozzles (not shown) onto a medium (also not shown).

The manifold 160 includes a manifold container 162 and a manifold rim 164. The ink container 110 communicates fluid to the manifold 160 through a filter 166 that is disposed within the manifold rim 164. The bottoms of the heatsink 154, the ejection chip 156 and the manifold container 162 are overlaid by a face tape 170 that provides an interface seal. The face tape 170 includes a heatsink portion 172 covering the bottom of the heatsink 154, an open region 174 to enable the ejection chip 156 to pass fluid out from the fluid ejection nozzles onto the medium, and a manifold portion 176 covering the bottom of the manifold container 162. The fluid passes from the ink container 110 through the filter 166 to the manifold container 162. The fluid is released from the manifold container 162 to the ejection chip 156 through the intake ports 158.

The refill port 180 can be mounted to the ink container 110 along a wall shared by the free chamber 116. The refill port 180 provides an access from which to initially fill the ink container 110 during original manufacture. The refill port 180 also provides the access from which to refill the ink container 110 with fluid after the previously supplied fluid has been expended.

When initially filling the ink container 110 with fluid, the ventilation port 122 is sealed by a gasket, and internal air is evacuated from the ink container 110 to form at least a partial vacuum at a negative gauge pressure (i.e., below ambient pressure). The fluid is transferred through the refill port 180 into the free chamber 116. As the free chamber 116 is filled, some of the fluid passes under the partition 114 into the cartridge medium chamber 112. Upon filling the free chamber 116, a small air bubble (resulting from incomplete evacuation) remains in the free chamber 116, with the remainder of the free chamber 116 containing the fluid. Meantime, the cartridge medium chamber 112 is about half to two-thirds filled with fluid.

During transport and/or initial installation, the ambient pressure and temperature can vary (e.g., decrease in barometric pressure from changes in altitude, or temperature rise during a diurnal cycle or latitude change). Such environments can cause pressure changes in the cartridge medium chamber 112 from the conditions during the initial filling operation. The changes in internal pressure in the cartridge medium chamber 112 can cause the fluid to expand and migrate through the ventilation port 122. Also, changes in orientation of the inkjet printer cartridge 100 can cause gravity-induced flow to the upper regions of the cartridge medium chamber 112 and into through the ventilation port 122. Fluid escaping through the ventilation port 122 can cause undesired leakage of fluid out of the cartridge reservoir 110. Various exemplary embodiments of this invention are designed to inhibit or prevent such potential leaks.

Additionally, passages in the ventilation port 122 should be clear of obstacles so that air can communicate from ambient conditions to the cartridge medium chamber 112. While printing, for example, the fluid is expended through the ejection chip 156 being drawn from the manifold chamber 162. The fluid in the manifold chamber 162 is supplied from the ink container 110, through free chamber 116 and/or the cartridge medium chamber 112. As the free chamber 116 is being emptied of the fluid, the cartridge medium chamber 112 replenishes the fluid from under the partition 114.

During this siphoning, the fluid level of the free chamber 116 rises while the fluid level of the cartridge medium chamber 112 drops, and ambient air enters from the ventilation port 122 into the cartridge medium chamber 112 to equilibrate the pressure. The fluid levels thereby equilibrate in a manner analogous to a manometer. During operation of a fluid printhead, the ink container 110, which maintains a constant internal volume, must be vented in order to allow the fluid to be removed, and therefore maintain a steady delivery pressure of the fluid to the nozzles. Without ambient air entering the cartridge medium chamber to replace the fluid that replenishes the free chamber 116, the fluid would become trapped by the lower pressure in the ink container 110, and propagated to the manifold chamber 162 and to the ejection chip 156. Thus, the ventilation port 122 must enable passage of air without obstruction from the fluid.

Figure 3:
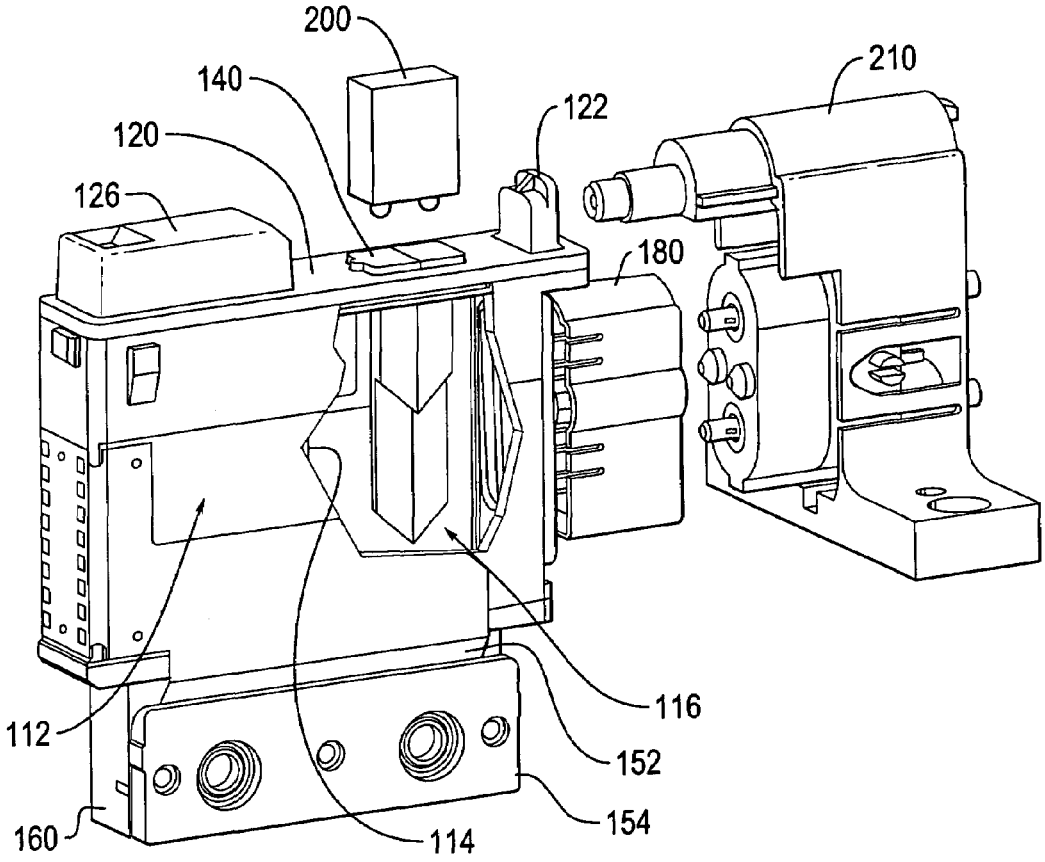
FIG. 3 shows an isometric view of an exemplary embodiment of an inkjet cartridge according to this invention.

FIG. 3 shows the inkjet printer cartridge 100 of FIG. 2 and an associated cartridge refill system. A sensor 200 provides a light source and receiver for determining a level of fluid within the free chamber 116. A refill station 210 provides instruments to engage the ventilation port 122 and the refill port 180 in order to refill the ink container 110 to appropriate levels.

Figure 4:
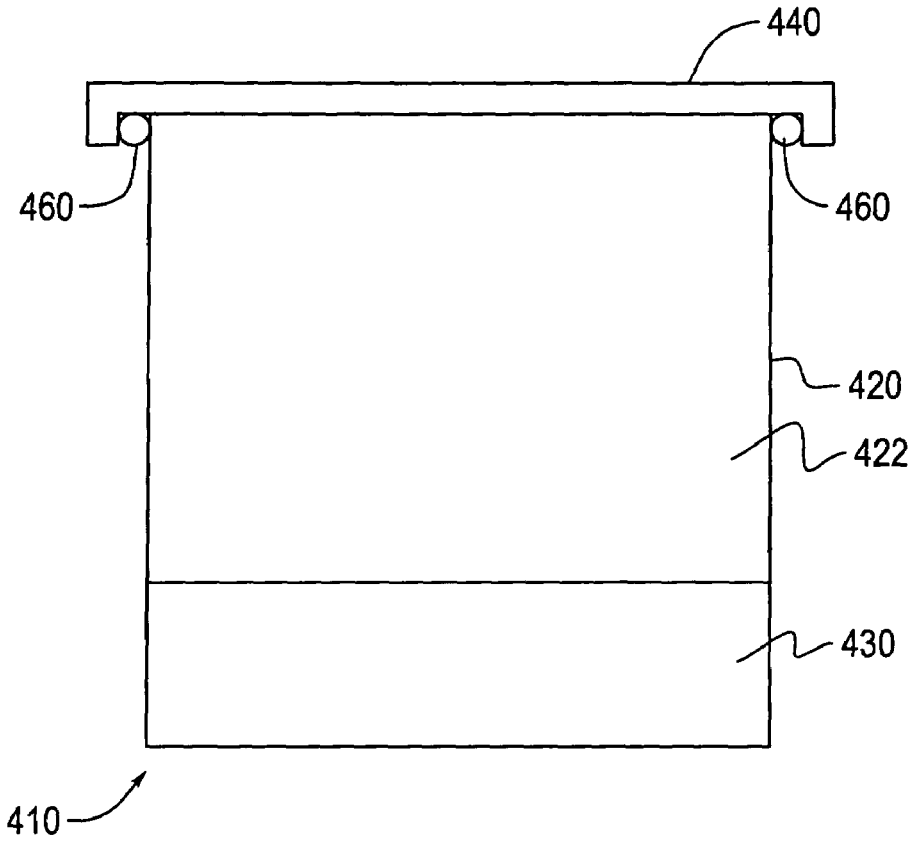
FIG. 4 shows a schematic cross section of an exemplary embodiment of an inkjet cartridge according to this invention.

FIG. 4 schematically depicts an exemplary embodiment of an inkjet cartridge 410 according to this invention. The inkjet cartridge 410 includes a container 420 and a cover 440. The container 420 has an inner cavity 422 that is suitable for storing ink and providing the ink to the printhead 430. The cover 440 is positioned over the container 420 to seal the inner cavity 422. A gasket 460 is interposed between an inner surface of the cover 440 and an outer surface of the container 420. The gasket 460 functions to seal the container 420 and the cover 440 of the inkjet cartridge 410. The gasket 460 also permits the cover 440 to be removed from and replaced on the container 420, as necessary in installation, operation, repair and replacement of the inkjet cartridge 410 in a printing device.

Figure 5:
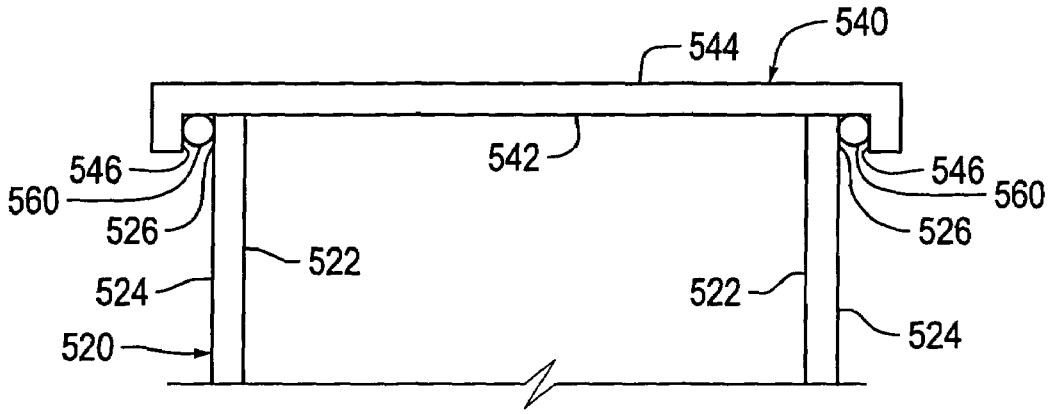
FIG. 5 shows a schematic cross section view of an exemplary embodiment of the mechanism for sealing a cover to a container for storing ink in an inkjet cartridge according to this invention.

FIG. 5 shows a cross-section view of an ink container 520 that is part of an inkjet cartridge. FIG. 5 includes only details pertaining to the closure of the container 520. A cover 540 and the container 520 are sealed together using a gasket 560. In various exemplary embodiments, the cover 540 and/or the container 520 are formed from one or more substances including, but not limited to, polyphenylene sulfide, liquid crystal polymer, syndiotactic polystyrene, polyethylene napthalate and DELRIN. The gasket 560 is compressed in a direction normal to the direction in which cover 540 is attached to the container 520. The cover 540 includes an inside surface 542, an outside surface 544 and an inner edge 546 on the inside surface 542. The inner edge 546 of the inside surface 542 ensures that the gasket 560 is not under compressed, which could compromise the fluid seal between the cover 540 and the container 520. Maintaining a proper seal is critical to the stable operation of an inkjet cartridge.

In various exemplary embodiments, the container 520 includes an inside surface 522, an outside surface 524 and a peripheral edge 526 of the outside surface 524 adjacent to an opening of the container 520. In various exemplary embodiments, the container 520 is sealed by mounting the gasket 560 so that it circumscribes the container at the peripheral edge 526 of the outside surface 524. The peripheral edge 526 can be formed with an indentation or protrusions to corral the gasket 560, thus preventing the gasket 560 from moving during operation or application of the cover 540. The container 520 is closed by placing the cover 540 over the container 520 such that the gasket 560 is interposed between the peripheral edge 526 of the container 520 and the inner edge 546 of the cover 540.

Sealing of the container 520 by placement of the cover 540 can be eased by lubricating the gasket 560. In various exemplary embodiments, the gasket 560 is coated with a lubricant prior to fitting the gasket 560 on the container 520 and/or prior to placement of the cover 540 on the container 520. In various exemplary embodiments, the lubricant is one or more of polyethylene glycol and TEFLON. In various exemplary embodiments, the inner edge 546 of the cover 540 is coated with a lubricant in addition to or in alternative to coating the gasket 560. In various exemplary embodiments, the gasket 560 itself is formed with a constituent lubricant.

When the cover 540 is placed over the container 520, the gasket 560 is compressed by the peripheral edge 526 of the container 520 and the inner edge 546 of the cover 540. Once the cover 540 has been placed over the container 520, the gasket 560 is compressed in a direction normal to the direction in which the cover 540 was placed over the container 520. Compression in this direction causes the gasket 560 to form a seal between the cover 540 and the container 520. Also, compression in this direction prevents compression forces from acting in a direction that could result in separation of the cover 540 from the container 520.

The gasket 560 can take any shape that is suitable to form an effective seal between the cover 540 and the container 520. In various exemplary embodiments, the gasket 560 has a uniform cross section, as, for example, in an O-ring. In various other exemplary embodiments, the gasket 560 has a non-uniform cross section, so as to accommodate differences in shape between the peripheral edge 326 of the container 520 and the inner edge 546 of the cover 540.

Various exemplary embodiments of the mechanism for sealing a cover to a container for storing ink in an inkjet cartridge according to this invention, include a feature for securing a cover to a container in addition to a gasket. Some such exemplary embodiments are shown in FIGS. 6–9. In addition to the supplemental attachment methods described below, any known or later developed technique for attaching two or more solid articles can be employed.

Figure 6:
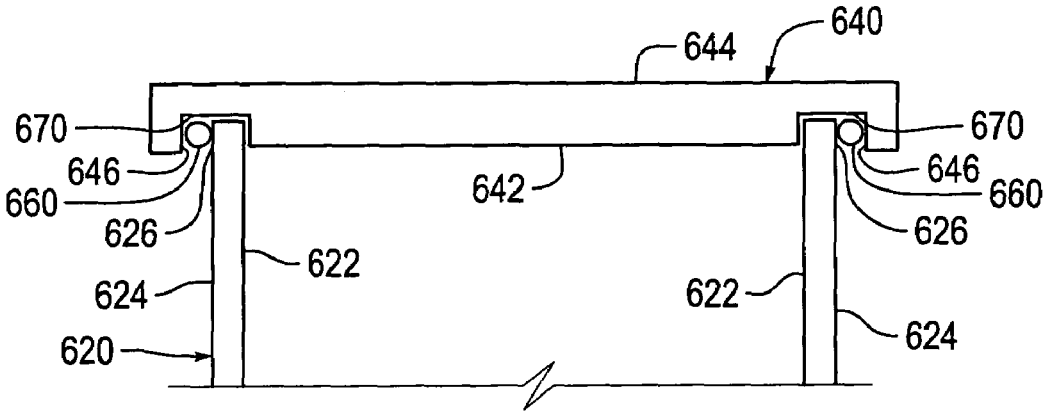
FIG. 6 shows a schematic cross section view of an exemplary embodiment of the mechanism for sealing a cover to a container for storing ink in an inkjet cartridge according to this invention.

FIG. 6 shows a cross-section view of an ink container 620 that is part of an inkjet cartridge. FIG. 6 includes only details pertaining to the closure of the container 620. A cover 640 and the container 620 are sealed together using a gasket 660. The container 620 includes an inside surface 622, an outside surface 624 and peripheral edge 626 of the outside surface 624 adjacent to an opening of the container 620. The cover 640 includes an inside surface 642, an outside surface 644 and an inner edge 646 on the inside surface 642. When the cover 640 is placed over the container 620, the gasket 660 is compressed by the peripheral edge 626 of the container 620 and the inner edge 646 of the cover 640 to seal the cover 640 to the container 620.

The cover 640 is provided with a channel 670. When the cover 640 is placed over the container 620, a rim 628 of the container and the gasket 660 fit into the channel 670, such that the gasket 670 is compressed against one edge of the channel 670 while the rim 628 is compressed against the other edge of the channel 670. This pressure against the edges of the channel 670, though normal to the direction in which the cover 640 is placed on the container 620, acts to resist separation of the cover 640 from the container 620.

Figure 7:
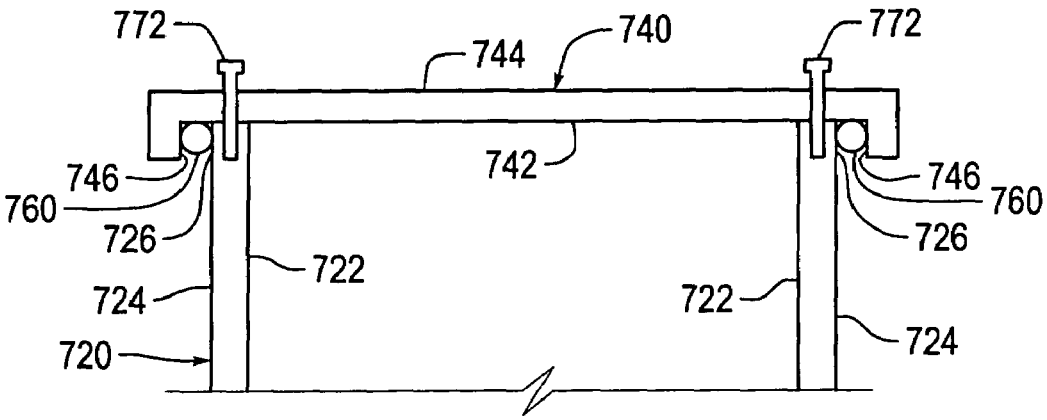
FIG. 7 shows a schematic cross section view of an exemplary embodiment of the mechanism for sealing a cover to a container for storing ink in an inkjet cartridge according to this invention.

FIG. 7 shows a cross-section view of an ink container 720 that is part of an inkjet cartridge. FIG. 7 includes only details pertaining to the closure of the container 720. A cover 740 and the container 720 are sealed together using a gasket 760. The container 720 includes an inside surface 722, an outside surface 724 and peripheral edge 726 of the outside surface 724 adjacent to an opening of the container 720. The cover 740 includes an inside surface 742, an outside surface 744 and an inner edge 746 on the inside surface 742. When the cover 740 is placed over the container 720, the gasket 760 is compressed by the peripheral edge 726 of the container 720 and the inner edge 746 of the cover 740 to seal the cover 740 to the container 720.

After the cover 740 is placed over the container 720, screws 772 are driven through the cover 740 and into the container 720. The screws 772 apply a force parallel to the direction that the cover 740 is placed over the container 720. This force will resist any opposite force tending to cause separation of the cover 740 from the container 720. However, this force does not act to further compress the gasket 760.

Figure 8:
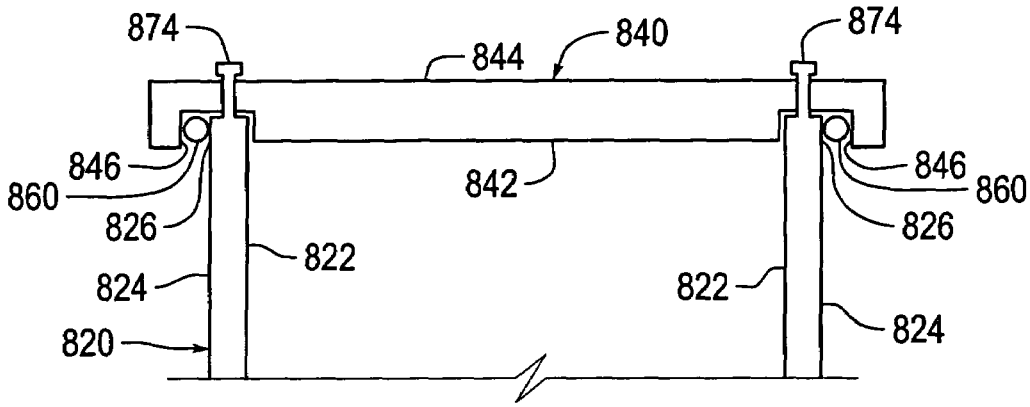
FIG. 8 shows a schematic cross section view of an exemplary embodiment of the mechanism for sealing a cover to a container for storing ink in an inkjet cartridge according to this invention.

FIG. 8 shows a cross-section view of an ink container 820 that is part of an inkjet cartridge. FIG. 8 includes only details pertaining to the closure of the container 820. A cover 840 and the container 820 are sealed together using a gasket 860. The container 820 includes an inside surface 822, an outside surface 824 and peripheral edge 826 of the outside surface 824 adjacent to an opening of the container 820. The cover 840 includes an inside surface 842, an outside surface 844 and an inner edge 846 on the inside surface 842. When the cover 840 is placed over the container 820, the gasket 860 is compressed by the peripheral edge 826 of the container 820 and the inner edge 846 of the cover 840 to seal the cover 840 to the container 820.

The container 820 includes heat stake posts 874 that are used to attach the cover 840 to the container 820. The cover includes apertures (not shown) that accommodate the heat stake posts 874. After the cover 840 is placed over the container 820, thermal energy is applied to the heat stake posts 874 to secure the cover 840 to the container 820. The heat stake posts 874 apply a force parallel to the direction that the cover 840 is placed over the container 820. This force will resist any opposite force tending to cause separation of the cover 840 from the container 820. As an alternative to heat staking, rivets could be used or the cover and container could be welded, if desired. Again, this force applied by the heat stakes does not act to further compress the gasket 860.

Figure 9:
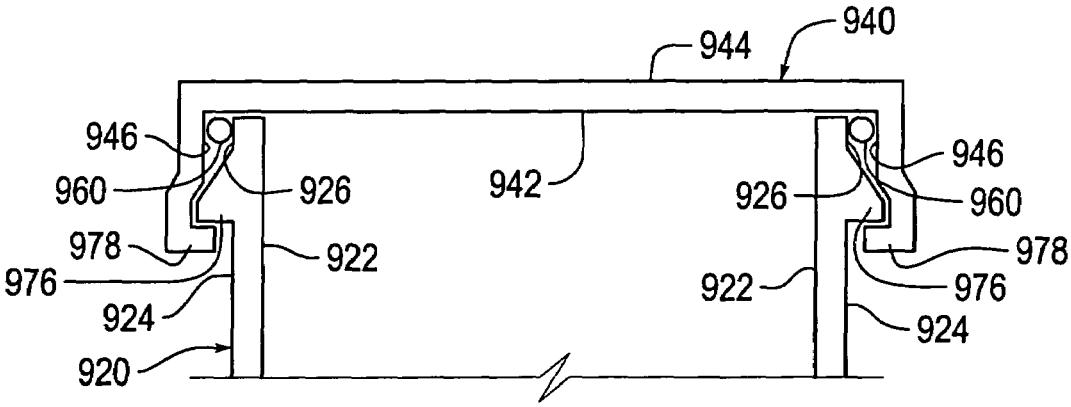
FIG. 9 shows a schematic cross section view of an exemplary embodiment of the mechanism for sealing a cover to a container for storing ink in an inkjet cartridge according to this invention.

FIG. 9 shows a cross-section view of an ink container 920 that is part of an inkjet cartridge. FIG. 9 includes only details pertaining to the closure of the container 920. A cover 940 and the container 920 are sealed together using a gasket 960. The container 920 includes an inside surface 922, an outside surface 924 and peripheral edge 926 of the outside surface 924 adjacent to an opening of the container 920. The cover 940 includes an inside surface 942, an outside surface 944 and an inner edge 946 on the inside surface 942. When the cover 940 is placed over the container 920, the gasket 960 is compressed by the peripheral edge 926 of the container 920 and the inner edge 946 of the cover 940 to seal the cover 940 to the container 920.

After the cover 940 is placed over the container 920, a snapping mechanism is used to further secure the container 920 and cover 940. The snapping mechanism includes one or more protrusions 976 on the container 920 and one or more receiving recesses 978 on the cover 940. The one or more protrusions 976 fit into the one or more recesses 978 to apply a force parallel to the direction that the cover 940 is placed over the container 920. This force will resist any opposite force tending to cause separation of the cover 940 from the container 920.

Figure 10A:
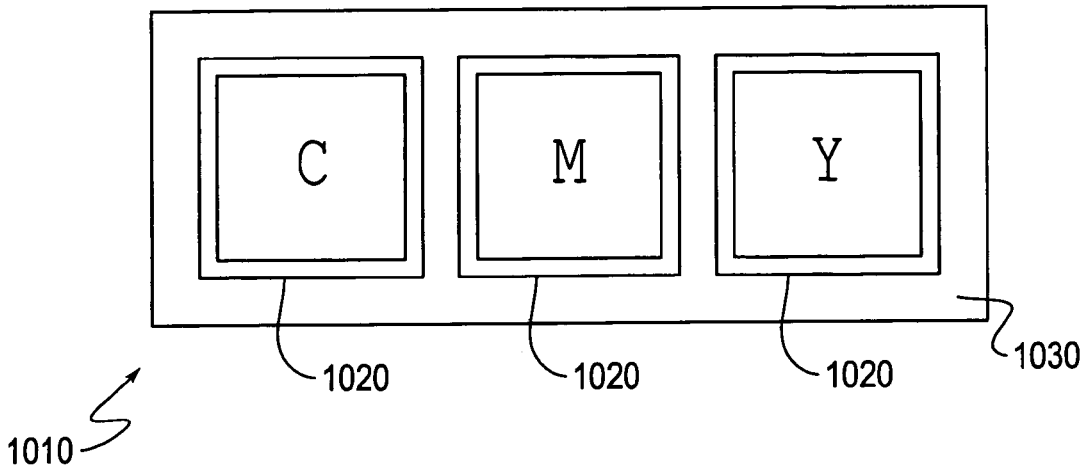
FIG. 10A shows a schematic top view of an exemplary embodiment of the mechanism for sealing a cover to a container for storing ink in an inkjet cartridge according to this invention (without cover)
Figure 10B:
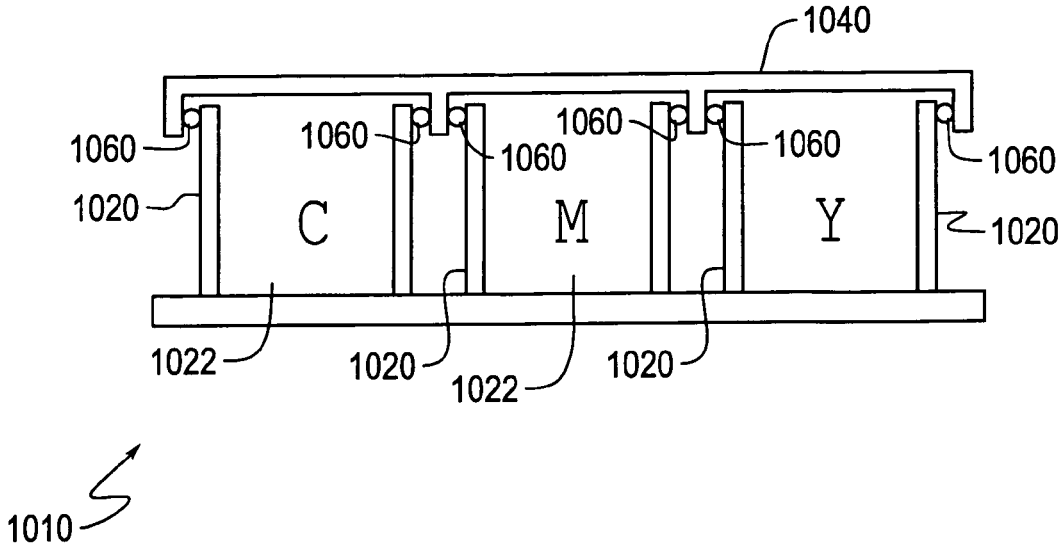
FIG. 10B shows a schematic side view of an exemplary embodiment of the mechanism for sealing a cover to a container for storing ink in an inkjet cartridge according to this invention (with cover).

FIGS. 10A and 10B schematically depict an exemplary embodiment of a multicolor inkjet cartridge 1010 according to this invention. FIG. 10A shows a top view of the inkjet cartridge 1010 in which a cover 1040 has been removed. FIG. 10B shows a side view of the inkjet cartridge 1010 in which the cover 1040 has been installed. The inkjet cartridge 1010 includes containers 1020 and a cover 1040. The inkjet cartridge 1010 includes three containers 1020, such as would be used in a cyan (C)-magenta (M)-yellow (Y) color printing system, sealed by a single cover 1040.

The containers 1020 each have an inner cavity 1022 suitable for storing ink and providing the ink to the printhead 1030. The cover 1040 is positioned over the containers 1020 to separately seal each of the inner cavities 1022. Gaskets 1060 are interposed between inner surfaces of the cover 1040 and outer surfaces of each of the containers 1020. The gaskets 1060 function to separately seal the containers 1020 and the single cover 1040 of the inkjet cartridge 1010. The gaskets 1060 also permit the cover 1040 to be removed from and replaced on the containers 1020, as necessary in installation, operation, repair and replacement of the inkjet cartridge 1010 in a printing device.

In addition to providing the previously described advantages of the present invention, the use of a single cover in a multi-container inkjet cartridge permits added precision in the architecture of the cartridge. For example, when three separate containers are molded, it is often difficult to precisely align the heights of each of the containers. As such, there may not be even spacing between the containers. This is because it is difficult to control the alignment of tall vertical structures. However, when a single cover is used to seal all of the containers, the shortcomings in the precision of the molding process are concealed by the cover, and the desired architectural precision is achieved since the cover can be precisely molded. The ink cartridge shown in FIGS. 10A and 10B includes three ink containers. The present invention, however, is not limited to any particular number or arrangement of ink containers. Printing systems requiring three, four, five and even six separate ink containers are well known, and the inkjet cartridge configurations described herein are equally applicable to such systems.

While this invention has been described in conjunction with the exemplary embodiments outlined above, various alternatives, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the claims as filed and as they may be amended are intended to embrace all known or later developed alternatives, modifications, variations, improvements, and/or substantial equivalents.

What is claimed is:

1. A mechanism for sealing a cover to a container for storing ink in an inkjet cartridge, comprising:

a container for storing ink having an inside surface, an outside surface and a peripheral edge of the outside surface adjacent to an opening of the container;

a cover having an inside surface, an outside surface and an extension member extending from the cover in a direction substantially along the outside surface of the container and substantially perpendicular to a direction that the inside surface of the cover extends, the cover being structured so as to fit over the container so that the extension member is peripherally outside the outside surface of the container and a space is formed between the outside surface of the container at substantially the peripheral edge of the outside surface of the container and a surface of the extension member of the cover that faces toward the container when the container is closed; and a gasket situated in the space such that when the container is closed the gasket is disposed between and in contact with the outside surface of the container at substantially the peripheral edge of the outside surface of the container and the surface of the extension member of the cover that faces toward the container.

2. The mechanism of claim 1, wherein at least one of the container and the cover is formed from a polymer.

3. The mechanism of claim 2, wherein the polymer is an acetal homopolymer.

4. The mechanism of claim 2, wherein the polymer is a liquid crystal polymer.

5. The mechanism of claim 1, wherein a rim of the container and the gasket are fitted into a channel formed in the cover.

6. The mechanism of claim 1, wherein the cover is fastened to the container with at least one screw.

7. The mechanism of claim 1, wherein the cover is fastened to the container with at least one heat stake.

8. The mechanism of claim 1, wherein the cover is provided with one or more protrusions, the container is provided with one or more retaining surfaces for retaining the one or more protrusions, and the cover is fastened to the container by engagement of the one or more protrusions by the one or more retaining surfaces.

9. An inkjet cartridge comprising the mechanism of claim 1.

10. A printing device comprising the inkjet cartridge of claim 9.

11. A mechanism for sealing a cover to at least two containers for storing ink in an inkjet cartridge, comprising:

at least two containers for storing ink, each container having an inside surface, an outside surface and a peripheral edge of the outside surface adjacent to an opening of the container;

a cover having at least two inside surfaces corresponding to the at least two containers, each inside surface having an extension member extending from the cover in a direction substantially along the outside surface of the container and substantially perpendicular to a direction that the inside surface of the cover extends, the cover being structured so as to fit over each of the at least two containers so that the extension member is peripherally outside the outside surface of each of the containers and a space is formed between the outside surface of each container at substantially the peripheral edge of the outside surface of each container and a surface of the extension member of the corresponding inside surface of the cover that faces toward the container when the containers are closed; and a gasket situated in the space such that when the at least two containers are closed each gasket is disposed between and in contact with the outside surface of each container at substantially the peripheral edge of the outside surface of the container and the surface of the extension member of the corresponding inside surface of the cover that faces toward the container.

12. The mechanism of claim 11, wherein at least one of the at least two containers and the cover is formed from a polymer.

13. The mechanism of claim 12, wherein the polymer is an acetal homopolymer.

14. The mechanism of claim 12, wherein the polymer is a liquid crystal polymer.

15. The mechanism of claim 11, wherein a rim of each container and the corresponding gasket are fitted into channels formed in the cover.

16. The mechanism of claim 11, wherein the cover is fastened to the at least two containers with at least one screw.

17. The mechanism of claim 11, wherein the cover is fastened to the at least two containers with at least one heat stake.

18. The mechanism of claim 11, wherein the cover is provided with one or more protrusions, the at least two containers are provided with one or more retaining surfaces for retaining the one or more protrusions, and the cover is fastened to the at least two containers by engagement of the one or more protrusions by the one or more retaining surfaces.

19. An inkjet cartridge comprising the mechanism of claim 11.

20. A printing device comprising the inkjet cartridge of claim 19.

* * * * *